US010888888B1

(12) United States Patent
Poudrier

(10) Patent No.: US 10,888,888 B1
(45) Date of Patent: Jan. 12, 2021

(54) UTILITY BUCKET LID

(71) Applicant: Alan Stanley Poudrier, Niceville, FL (US)

(72) Inventor: Alan Stanley Poudrier, Niceville, FL (US)

( * ) Notice: Subject to any disclaimer, the term of this patent is extended or adjusted under 35 U.S.C. 154(b) by 0 days.

(21) Appl. No.: 16/550,395

(22) Filed: Aug. 26, 2019

(51) Int. Cl.

| | |
|---|---|
| ***B05B 15/00*** | (2018.01) |
| ***B05B 9/043*** | (2006.01) |
| ***B65D 43/02*** | (2006.01) |
| ***B05B 11/00*** | (2006.01) |
| ***B05B 9/08*** | (2006.01) |
| *F04B 23/02* | (2006.01) |

(52) U.S. Cl.
CPC ..... *B05B 9/043* (2013.01); *B05B 9/0861* (2013.01); *B05B 11/3047* (2013.01); *B65D 43/0208* (2013.01); *B65D 2543/00092* (2013.01); *B65D 2543/00555* (2013.01); *F04B 23/028* (2013.01)

(58) Field of Classification Search
CPC ... B05B 9/043; B05B 9/0861; B05B 11/3047; B65D 43/0208; B65D 2543/00092; B65D 2543/00555; F04B 23/028
See application file for complete search history.

(56) References Cited

U.S. PATENT DOCUMENTS 3,255,967 A * 6/1966 Kenney ..... B05B 7/24 239/133
4,114,782 A * 9/1978 Berry ..... B05B 9/0403 222/382
4,235,377 A * 11/1980 Davis ..... B05B 3/087 239/215
10,641,254 B2 * 5/2020 Liao ..... F04B 53/1092
2004/0118940 A1 * 6/2004 Lavitt ..... B05B 9/0861 239/302
2009/0162214 A1 * 6/2009 Bonner ..... F04B 23/028 417/199.1

* cited by examiner

*Primary Examiner* — David P Angwin
*Assistant Examiner* — Bob Zadeh
(74) *Attorney, Agent, or Firm* — Peter Loffler

(57) ABSTRACT

A utility bucket lid uses a common bucket lid and one or more rigid support members to strengthen the bucket lid in order to secure a pump and rigid pipe to deliver on-demand water or other fluid via a fluid manifold and valve that is connected to the rigid pipe. The rigid support member(s) support a pump having a suction hose and discharge hose and the rigid support member(s) also support a rigid pipe. The rigid pipe is passed through the bucket lid and also through the rigid support member(s). The pump's suction hose is passed into a hole proximate the top end of the rigid pipe (above the top side of the bucket lid) and exists the rigid pipe through a second hole proximate the bottom end of the rigid pipe (below the bottom side of the bucket lid). The rigid pipe holds the position of the open end of the suction hose proximate the bottom of the bucket. The top end of the rigid pipe has an open end to accept a fluid manifold, the fluid manifold having a first end and a second end, an inlet fitting, and outlet fitting, and a valve. A pump is secured to the top side of the bucket lid being fastened to the device via securement holes in the rigid support member(s). The suction hose is appropriately attached to the suction port of the pump and a discharge hose is appropriately attached to the discharge port of the pump. A hose, shower wand, and even a towel holder can also be attached to the utility bucket lid for complete hygiene in primitive settings.

12 Claims, 6 Drawing Sheets

UTILITY BUCKET LID

BACKGROUND OF THE INVENTION

1. Field of the Invention

The present invention relates to a utility bucket lid that provides on-demand running water from a typical bucket when individuals are in environments where running water does not exist.

2. Background of the Prior Art

People who are occupied in various trades relating to construction, utility workers, or other fields where ground breaking work is in progress often find themselves in work environments for substantial periods of time before clean running water is available at the work site. Also, individuals involved in recreation such as primitive camping, tailgating, fishing, or other activities often do not have access to clean running water. Individuals might bring a supply of water in containers for washing hands for example prior to eating, but there is little control over the amount of water that is wasted when tipping a container to pour water onto one's hands. Individuals find that a significant portion of available water is wasted as it is poured from the container and over the hands. When the amount of water available is restricted to the size of a container individuals in work and recreational activities must minimize the amount of the water that is wasted when pouring from a bucket of other container.

Accordingly, there is a need in the art for a device that provides on-demand water in environments that do not have the public utility of clean running water. Such a device must provide on-demand water with minimal waste of the resource. Such a device must be of relatively simple construction and be easy to use.

SUMMARY OF THE INVENTION

The utility bucket lid of the present invention addresses the aforementioned needs in the art by providing a device that can be adapted to a typical bucket. It is relatively small in size, such that it can be transported with the container of water in the cargo area most vehicles. The device is primarily comprised of a common bucket lid and rigid support members that add sufficient strength to the bucket lid to enable the lid to support a pump, suction hose and discharge hose, and rigid pipe. One end of the rigid pipe is passed through the bucket lid and serves to hold the open end of the pump's suction hose proximate the bottom of the bucket. The opposite end of the rigid pipe extends above the bucket lid and serves to support a fluid manifold having an inlet fitting from the pump's discharge port and an outlet valve. A hose or shower wand can be attached to the outlet valve and a towel holder can also be attached to the utility bucket lid for complete hygiene in primitive settings. The utility bucket lid can quickly be secured to a common bucket and readily supply on-demand water in environments where the utility does not exist. The utility bucket lid is of relatively simple design and construction, being produced using standard manufacturing techniques, so that the device is relatively inexpensive to produce so as to be economically attractive to potential consumers for this type of device. Use and maintenance of the utility bucket lid is simple and straightforward.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

DESCRIPTION OF THE PREFERRED EMBODIMENT

Figure 1:
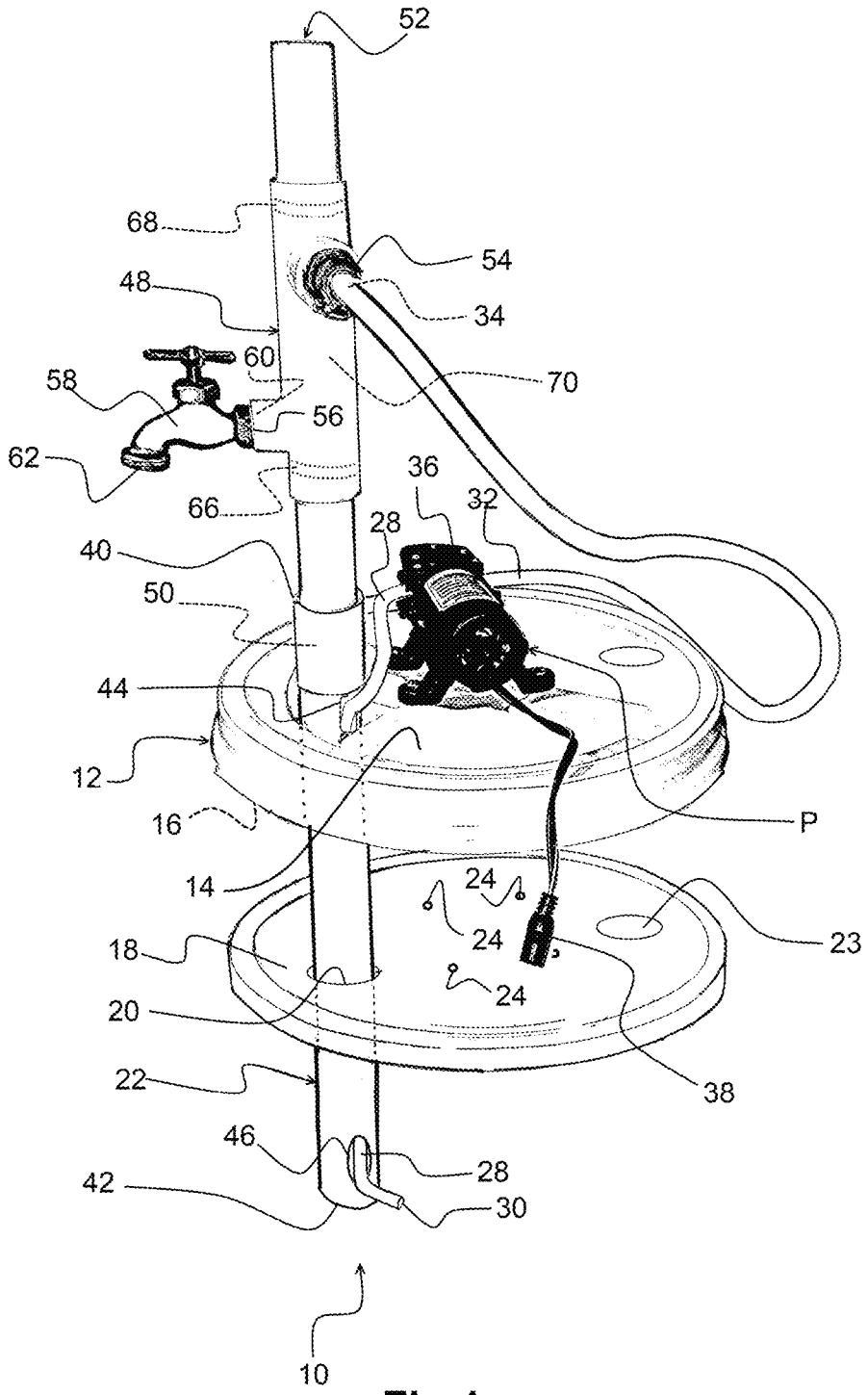
FIG. 1 is a perspective view of utility bucket lid.
Figure 2:
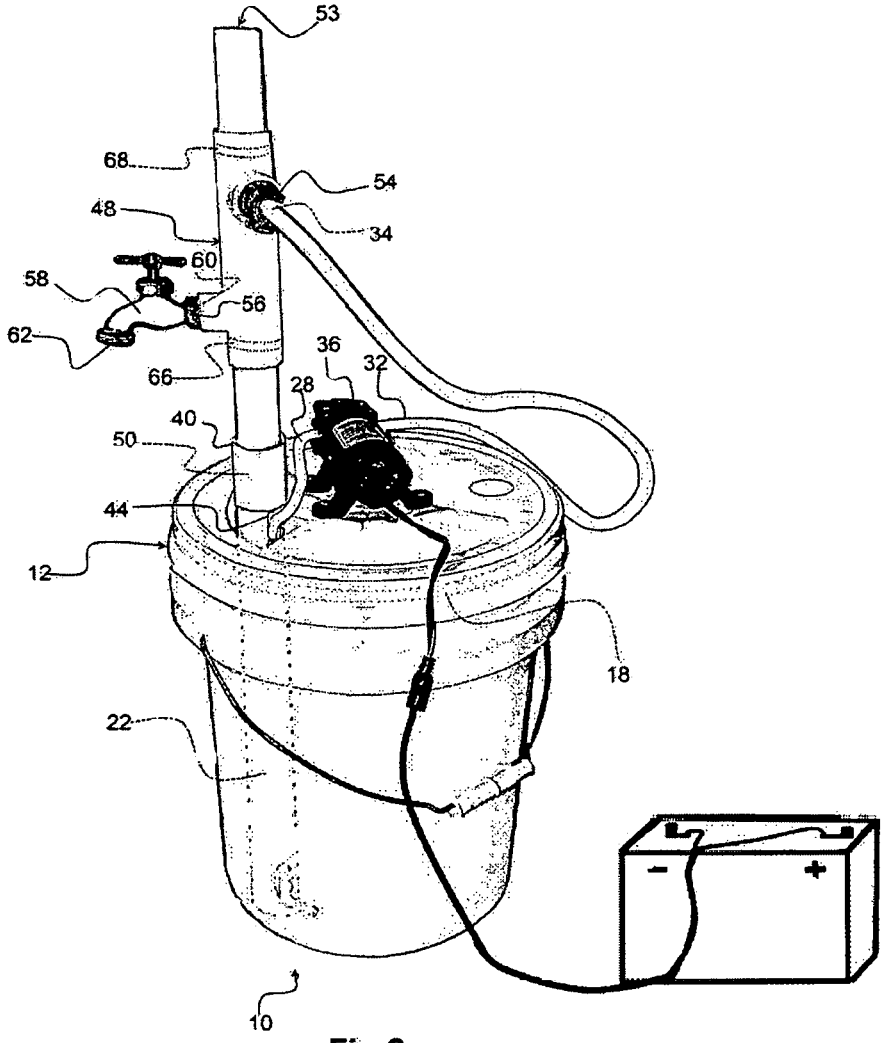
FIG. 2 is a perspective view of the utility bucket lid attached to a bucket.
Figure 3:
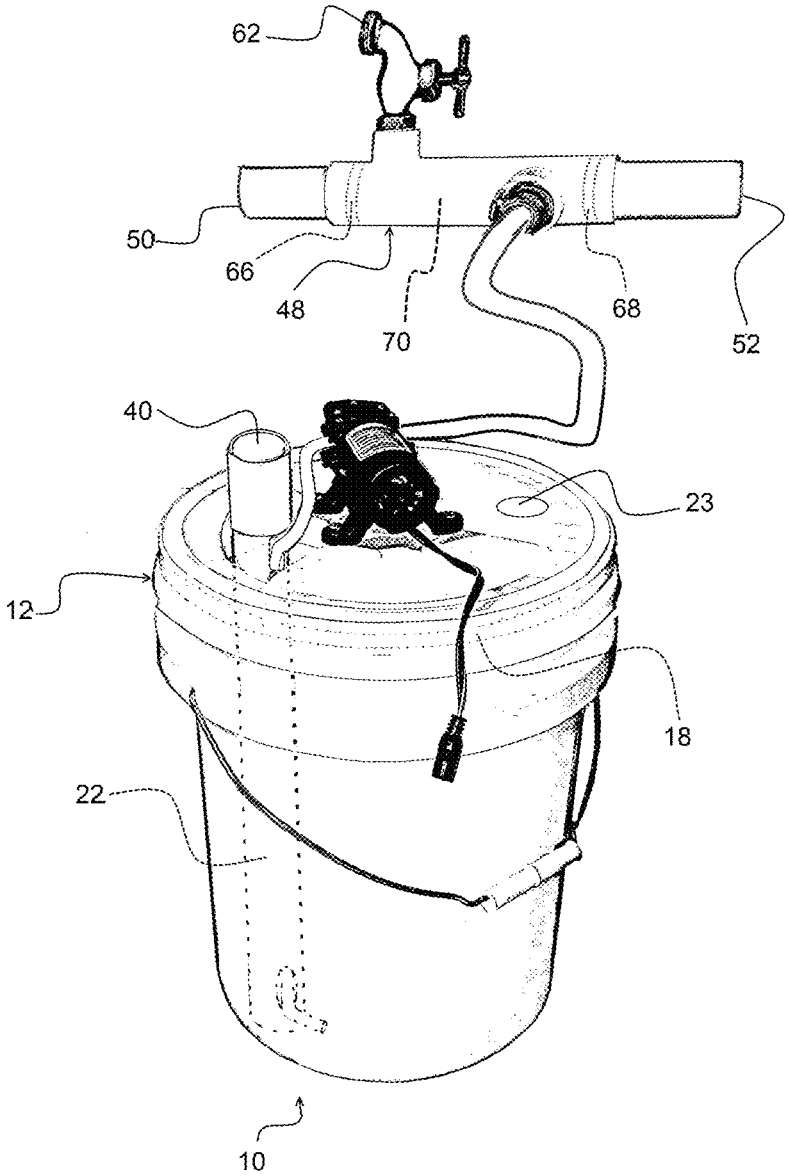
FIG. 3 is a perspective view of the utility bucket lid and the fluid manifold in a first alternative position.
Figure 4:
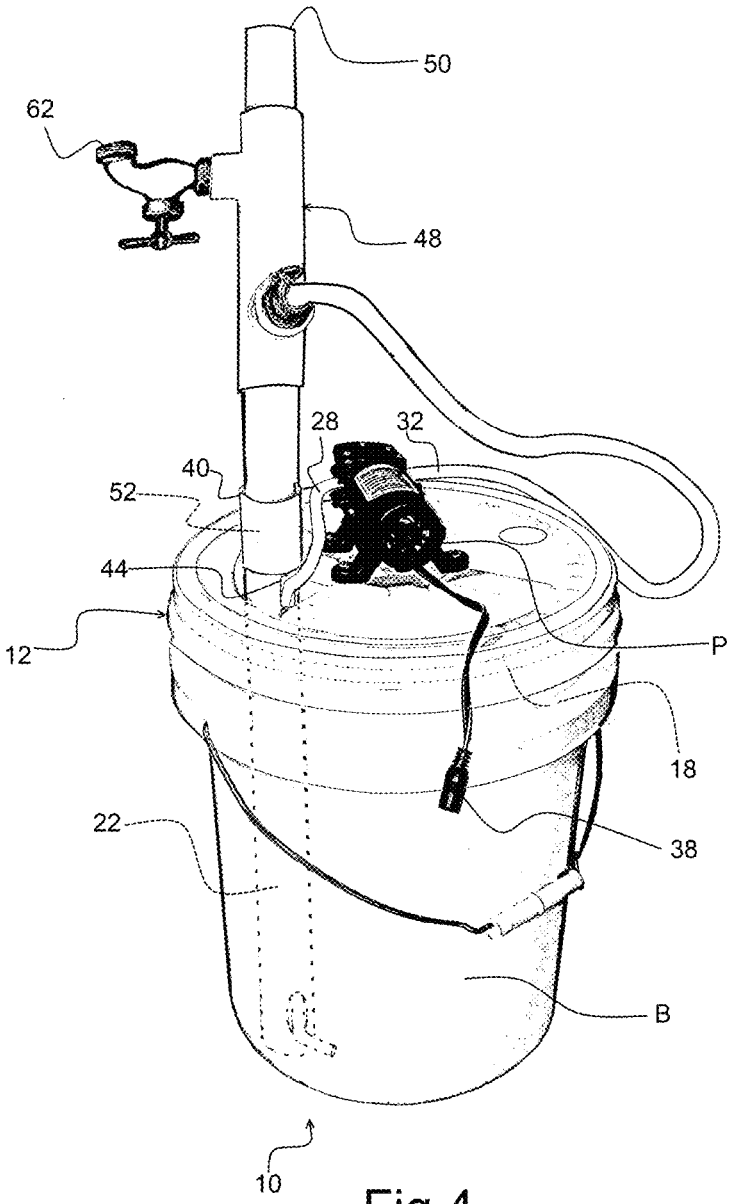
FIG. 4 is a perspective view of the utility bucket lid and the fluid manifold in a second alternative position.
Figure 5:
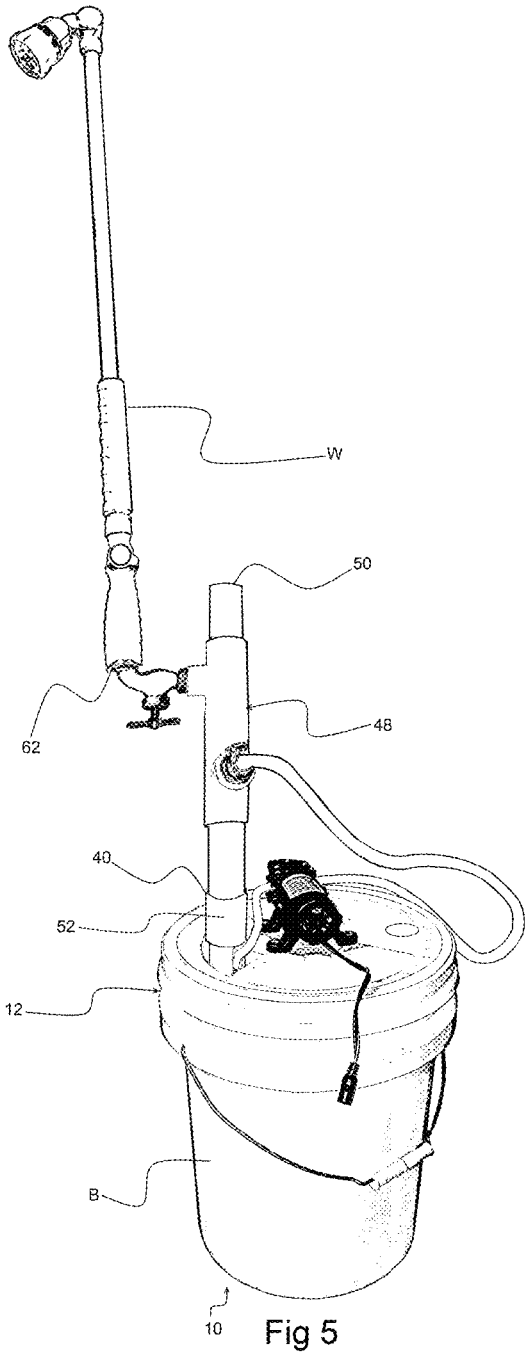
FIG. 5 is a perspective view of the utility bucket lid utilizing a shower wand.
Figure 6:
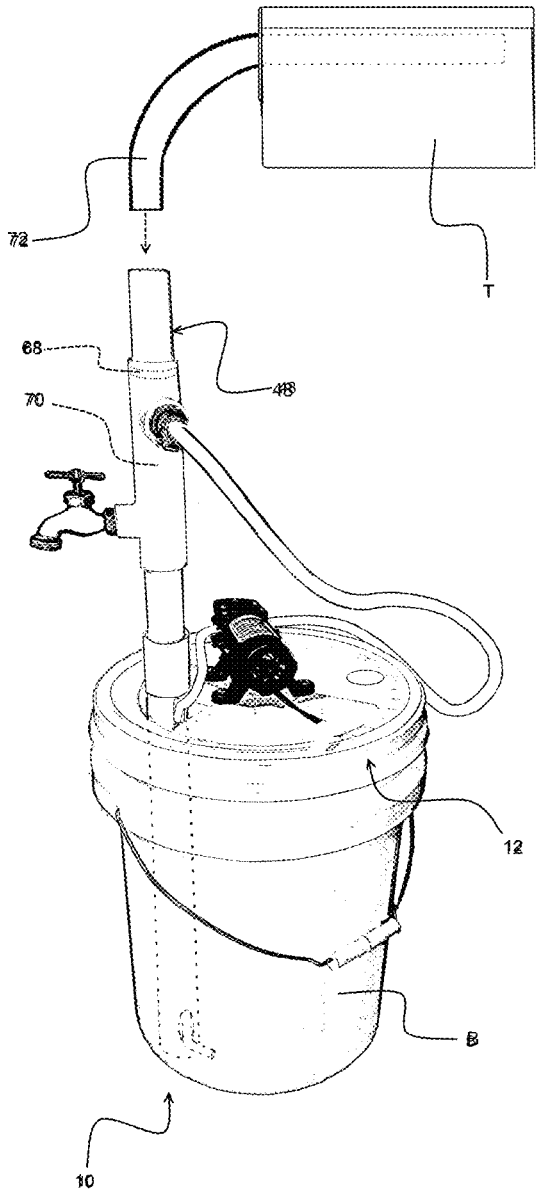
FIG. 6 is a perspective view of the utility bucket lid with a towel dispenser Similar reference numerals refer to similar parts throughout the several views of the drawings.

Referring now to the drawings, it is seen that the utility bucket lid of the present invention, generally denoted by reference numeral 10, is comprised of a generally round shaped bucket lid 12, having a top surface 14 and a bottom surface 16 and one or more rigid support members 18 below the bucket lid 12 and above (not shown) the bucket lid 12. The utility bucket lid 10 is preferably attached to a bucket B. The rigid support member(s) 18 having a hole 20 to allow a rigid pipe 22 to pass through the bucket lid 12 and rigid support member(s) 18. The rigid support member(s) 18 also having a fill hole 23 for refilling the bucket B without removing the utility bucket lid 10 from the bucket B. Fill hole 23 also passes through the bucket lid 12. The rigid support member(s) 18 also having holes 24 for attaching a pump P to the bucket lid 12. The pump P having an inlet hose 28. The inlet hose 28 having a suction opening 30. The pump P also having a discharge hose 32 with a discharge opening 34, and the pump P also having a pressure switch 36 and a power cord 38 (power supply not shown). The rigid pipe 22 has a top end 40, a bottom end 42, a first hole 44, and a second hole 46. The inlet hose 28 is in ruted from the pump P into the first hole 44 of the rigid pipe 22 and exits the rigid pipe 22 through the second hole 46 where suction opening 30 of the inlet hose 28 rests proximate the bottom of the bucket B. A multi-positional fluid manifold 48 is comprised of a first end 50, a second end 52, an inlet fitting 54, a discharge fitting 56, and a valve 58. The discharge opening 34 of the discharge hose 32 is appropriately connected to the inlet fitting 54 of the fluid manifold 48 and the inlet port 60 of the valve is appropriately connected to discharge fitting 56 of the fluid manifold 48. The outlet port 62 of the valve 58 is threaded to provide a means of connecting a hose (not shown) and/or spray wand W. The fluid manifold 48 also having a first plug 66 between the first end 50 and the discharge fitting 56, and a second plug 68 between the second end 52 and the outlet fitting 54 wherein the plugs (66, 68) provide a leak proof cavity 70 within the fluid manifold 48. The first end 50 of the fluid manifold 48 extends beyond the first plug 66 and the second end 52 of the fluid manifold 48 extends beyond the second plug 68. The position of the outlet port 62 of the valve 58 can be changed as desired to allow fluid to be pumped downward from the valve 58 by inserting the first end 50 of the fluid manifold 48 into the top end 40 of the rigid pipe 22, or fluid can be pumped upward from the valve 58 and into a hose (not shown) or shower wand by inserting the second end 52 of the fluid manifold 48 into the top end 40 of the rigid pipe 22. Either the first end 50 of the fluid manifold 48 or the second end 52 of the fluid manifold 48 can support a towel holder 72.

While the invention has been particularly shown and described with reference to an embodiment thereof, it will be appreciated by those skilled in the art that various changes in form and detail may be made without departing from the spirit and scope of the invention.

I claim:

1. A utility bucket lid for the pressurized discharge of a fluid contained within a bucket, said bucket lid comprising:

a top surface, a bottom surface, a rigid support member positioned against the top surface and/or a rigid support member positioned below the bottom surface, the rigid support member adding sufficient strength to the bucket lid to support and attach an electric pump to said bucket lid;

said pump has: i) an inlet hose having a suction opening, ii) a discharge hose having a discharge opening, and iii) a pressure switch that turns off power to said pump when predetermined pressure setting is reached; the utility bucket lid also having a rigid pipe passing through the bucket lid and also passing through the rigid support member wherein said rigid pipe has a top end, a bottom end, a first hole, and a second hole, wherein the first hole is located above said top surface and said second hole is located proximate the bottom end of said rigid pipe, wherein the first hole provides an opening for passing said inlet hose into said rigid pipe and into said bucket and said inlet hose exits said rigid pipe's second hole wherein the rigid pipe positions said suction opening of said inlet hose proximate the bottom of the bucket; said rigid pipe also having a top end located above the first hole; the bucket lid also having a multi-positional fluid manifold wherein said fluid manifold is comprised of a first end, a second end, an inlet fitting wherein said discharge opening of said discharge hose is connected to said inlet fitting of said fluid manifold, and said fluid manifold also having a discharge fitting and a valve wherein said valve having an inlet port and an outlet port wherein said valve's inlet port is connected to said fluid manifold's discharge fitting and wherein the outlet port of said valve is threaded to provide a means of connecting a hose and/or spray nozzle; the fluid manifold also having a first plug between the first end and said inlet fitting, and a second plug between said second end and an outlet fitting wherein said plugs provide a leak proof cavity within said fluid manifold and wherein the first end extends beyond the first plug and the second end extends beyond the second plug.

2. The utility bucket lid as in claim 1 wherein a power source is connected to the pump wherein the pump pulls the fluid into said inlet hose the bucket and said fluid is discharged into said discharge hose into said inlet fitting of said fluid manifold.

3. The utility bucket lid as in claim 2 wherein said valve is in a closed position and said fluid becomes pressurized within said fluid manifold and wherein said pressure switch of said pump turns pump off.

4. The utility bucket lid as in claim 3 wherein said valve is in an open position releasing pressure within said fluid manifold, wherein pump is turned on due to loss of pressure and said fluid is pumped from said bucket and is discharged through the valve's said outlet port.

5. The utility bucket lid as in claim 2 wherein said fluid manifold is removed from said rigid pipe and wherein said valve is in a closed position as and wherein the fluid becomes pressurized within said fluid manifold and wherein said pressure switch of said pump turns the pump off.

6. The utility bucket lid as in claim 1 wherein the first end of said fluid manifold is inserted into the top end of said rigid pipe.

7. The utility bucket lid as in claim 6 wherein the outlet port of said valve is positioned such that fluid is discharged in a downward direction when said valve is open.

8. The utility bucket lid as in claim 1 wherein the second end of said fluid manifold is inserted into the top end of said rigid pipe.

9. The utility bucket lid as in claim 8 wherein the outlet port of said valve is positioned such that the fluid from the bucket is discharged in an upward direction when said valve is open.

10. The utility bucket lid as in claim 9 wherein a shower wand is connected to the outlet port of said valve such that the fluid from the bucket is discharged in an upward direction, into the wand when said valve is open.

11. The utility bucket lid as in claim 1 wherein a towel support is attached to said bottom end of said fluid manifold.

12. The utility bucket lid as in claim 1 wherein a towel support is attached to said top end of said fluid manifold.

* * * * *